US006230366B1

(12) United States Patent
Lin

(10) Patent No.: US 6,230,366 B1
(45) Date of Patent: May 15, 2001

(54) MULTICOLORED HANDLE

(76) Inventor: Chang-Ming Lin, No. 331, Chang Chun St., Chiu Te Village Wu Jih Hsiang, Taichung County (TW)

( * ) Notice: Subject to any disclaimer, the term of this patent is extended or adjusted under 35 U.S.C. 154(b) by 0 days.

(21) Appl. No.: 09/562,012

(22) Filed: May 2, 2000

(51) Int. Cl.[7] ..... A45C 13/22

(52) U.S. Cl. ..... 16/431; 16/436; 81/177.1; 81/489

(58) Field of Search ..... 16/436, 431; 81/177.1, 81/489; 40/314, 317, 324, 331

(56) References Cited

U.S. PATENT DOCUMENTS 4,052,768 * 10/1977 Yamazaki et al. ..... 16/441
4,195,837 * 4/1980 Poulin ..... 40/317
6,108,870 * 8/2000 Lo ..... 16/431
6,122,802 * 9/2000 Lo ..... 16/431
6,128,808 * 10/2000 Jansson et al. ..... 16/431

* cited by examiner

*Primary Examiner*—Lynne H. Browne
*Assistant Examiner*—Aaron Dunwoody
(74) *Attorney, Agent, or Firm*—Harrison & Egbert

(57) ABSTRACT

A multicolored handle including a main body which is provided with a plurality of receiving slots in which a plurality of colored blocks and retaining rings are held securely in place such that the colored blocks and the retaining rings are level with the outer surface of the main body. The main body is different in color from the colored block and the retaining ring. The colored block is different in color from the retaining ring.

2 Claims, 7 Drawing Sheets

MULTICOLORED HANDLE

TECHNICAL FIELD

The present invention relates generally to a handle, and more particularly to a colored handle.

BACKGROUND ART

As shown in FIGS. 1 and 2, a colored handle 10 of the prior art comprises an inner body 11 and an outer body 13. In view of the inner body 11 and the outer body 13 being different in color, the colored handle 10 has two colors. The inner body 11 is provided with a plurality of buttons 12, whereas the outer body 13 is provided with a plurality of holes 14 corresponding in location to the buttons 12. The colored handle 10 is formed of the inner body 11 and the outer body 13, which are joined together such that the buttons 12 of the inner body 11 are fitted securely into the holes 14 of the outer body 13.

Such a prior art colored handle as described above is defective in design in that the colored handle has only two different colors, and that the colored handle is not cost-effective due to the high cost of production and molding the tool.

SUMMARY OF THE INVENTION

It is the primary objective of the present invention to provide a multicolored handle.

It is another objective of the present invention to provide a cost-effective multicolored handle.

In keeping with the principle of the present invention, the foregoing objectives of the present invention are attained by a multicolored handle comprising a main body and a plurality of colored blocks different in color and shape. The main body is provided with a plurality of receiving slots in which the colored blocks are retained in conjunction with a plurality of retaining rings, as well as the strong adhesive.

The foregoing objectives, features, and advantages of the present invention will be more readily understood upon a thoughtful deliberation of the following detailed description of a preferred embodiment of the present invention with reference to the accompanying drawings.

DETAILED DESCRIPTION OF THE PREFERRED EMBODIMENT

Figure 1:
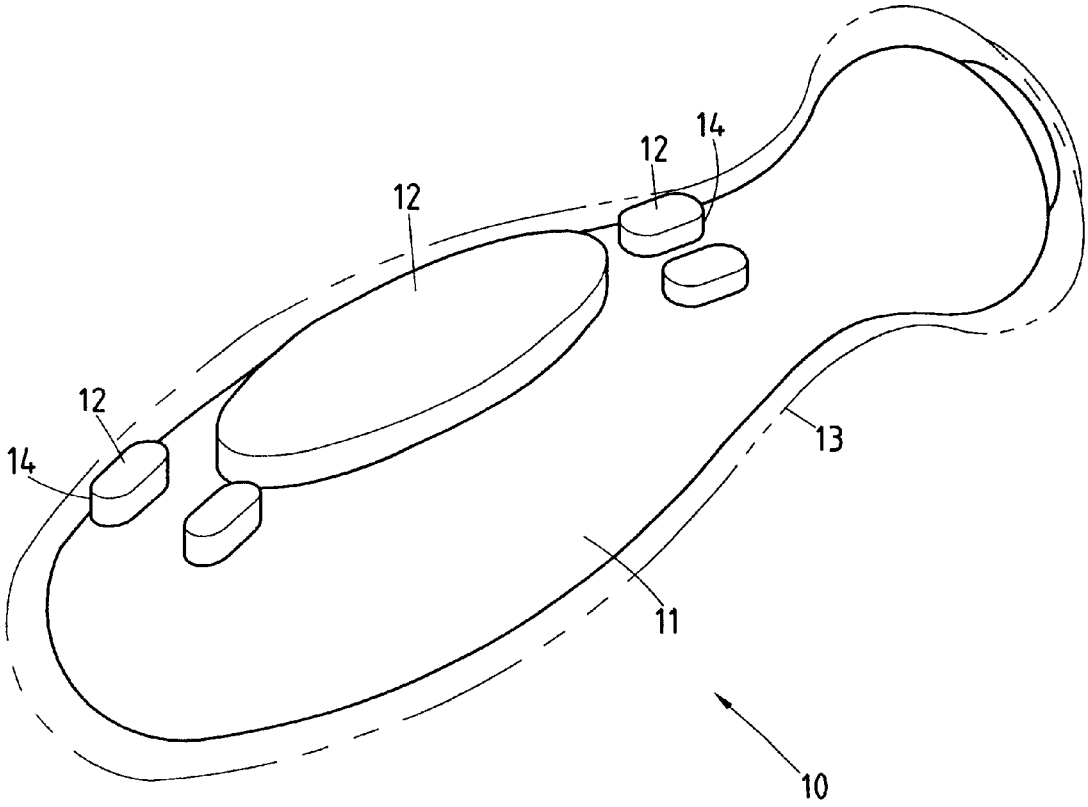
FIG.1 PRIOR ART
FIG. 1 shows a perspective view of a colored handle of the prior art.
Figure 2:
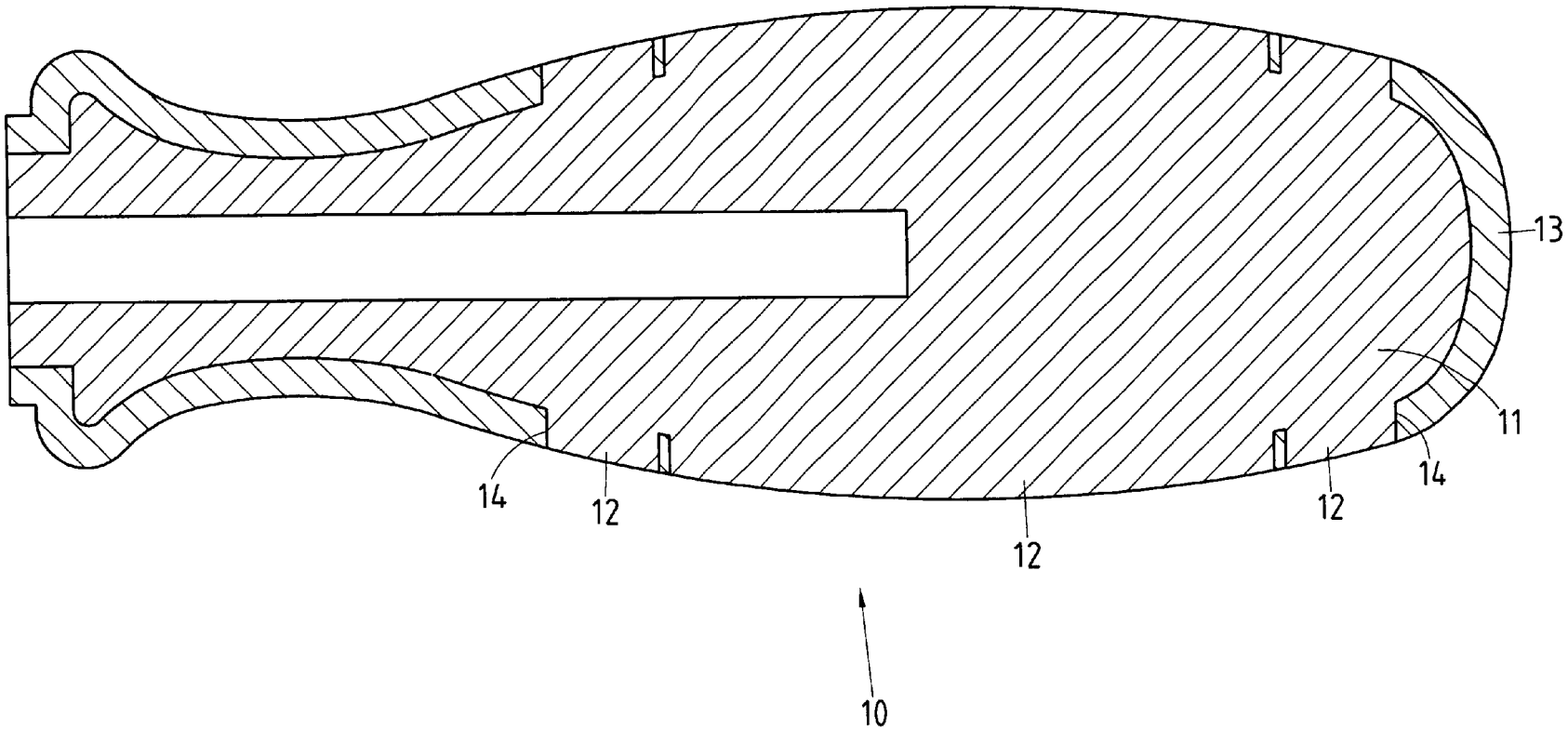
FIG. 2 PRIOR ART
FIG. 2 shows a longitudinal sectional view of the colored handle of the prior art.
Figure 3:
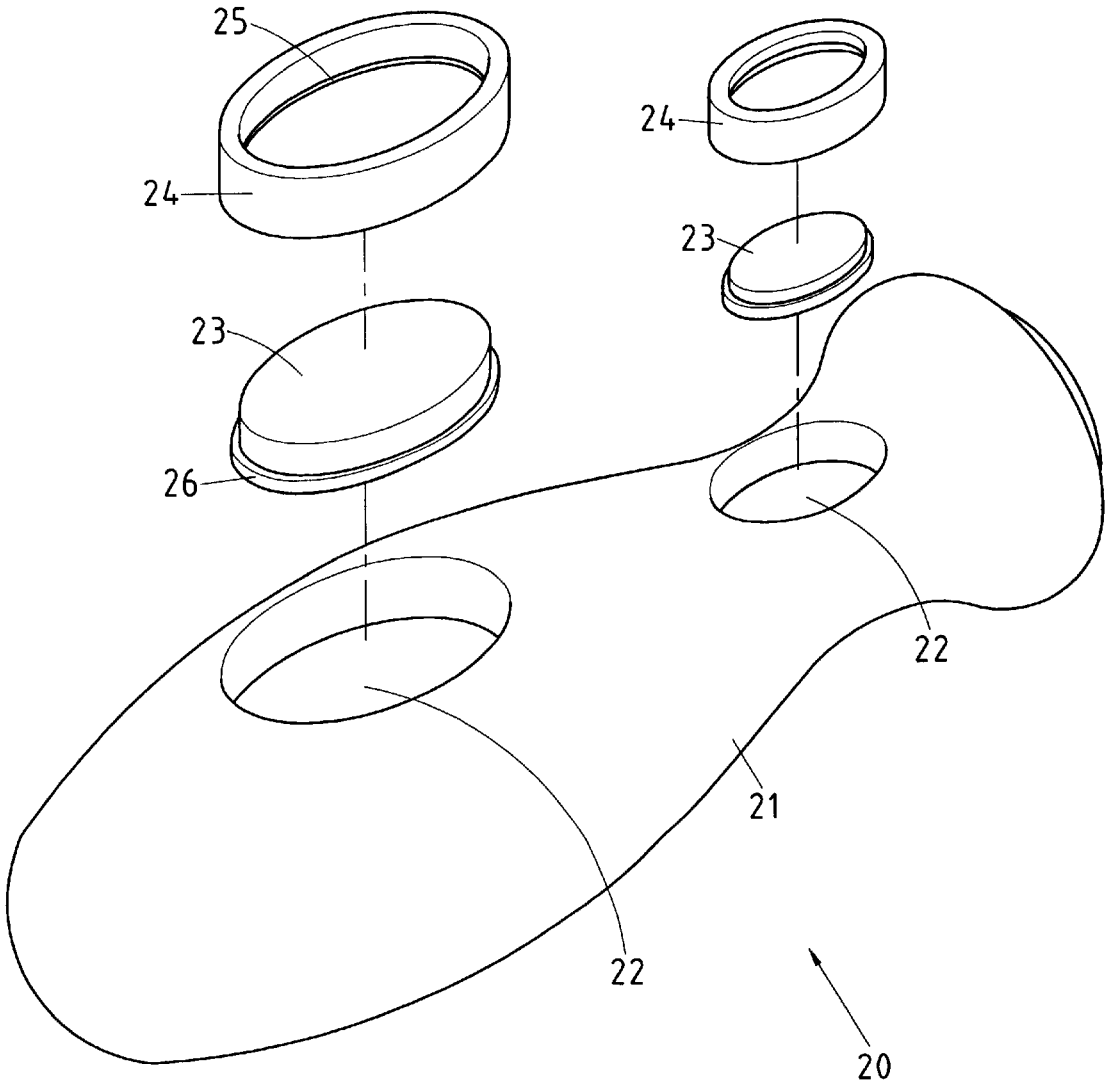
FIG. 3 shows an exploded view of a multicolored handle of the preferred embodiment of the present invention.
Figure 4:
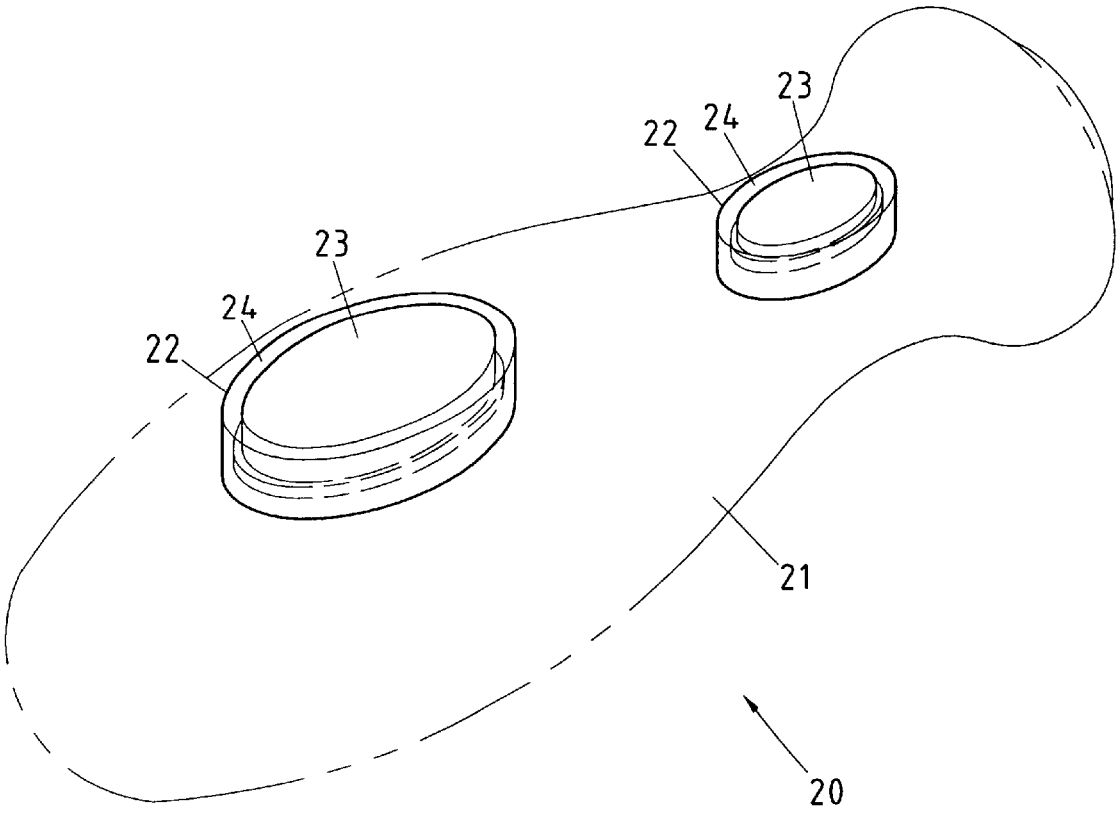
FIG. 4 shows a schematic perspective view of the multicolored handle of the preferred embodiment of the present invention.
Figure 5:
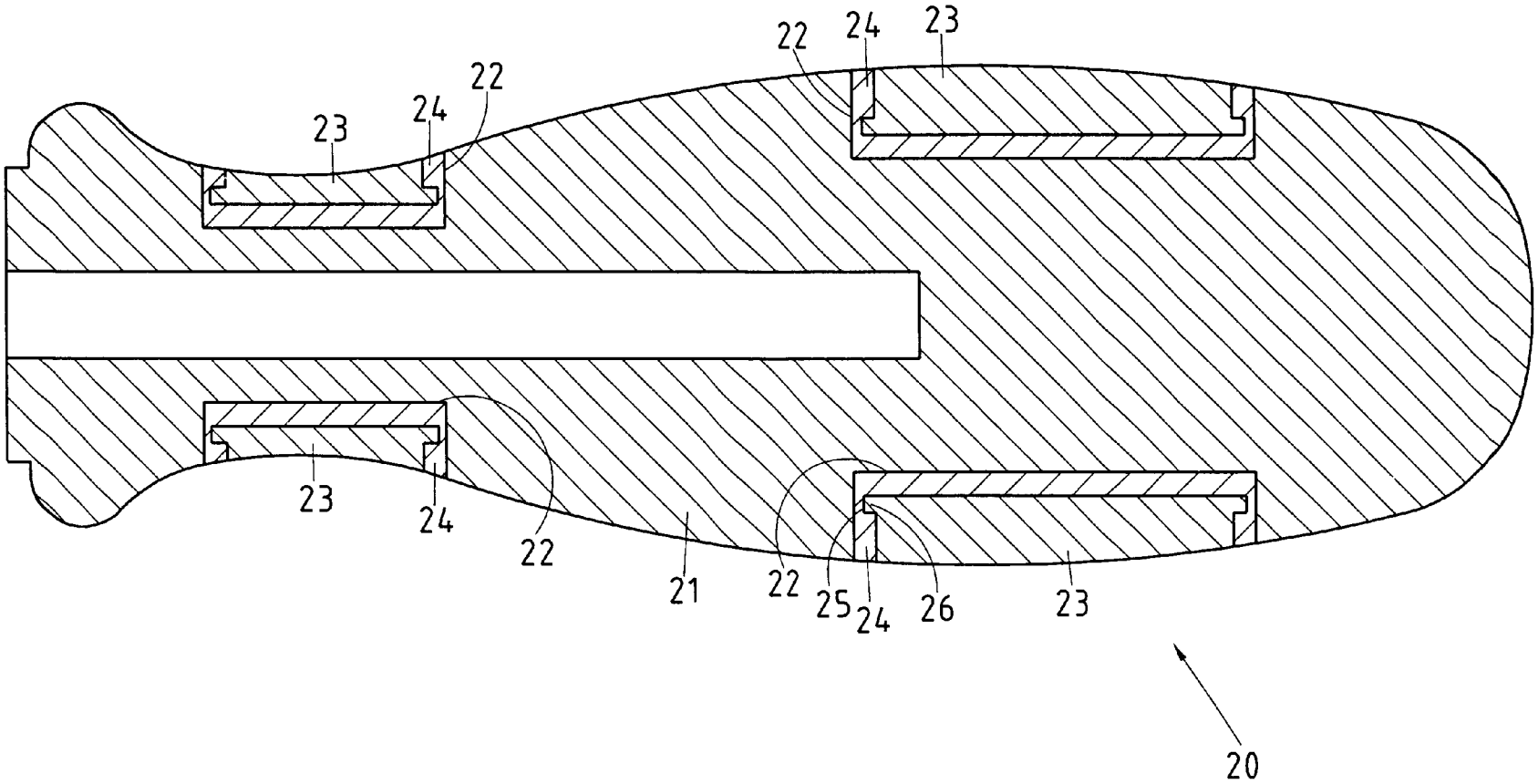
FIG. 5 shows a longitudinal sectional vies of the multicolored handle of the preferred embodiment of the present invention.
Figure 6:
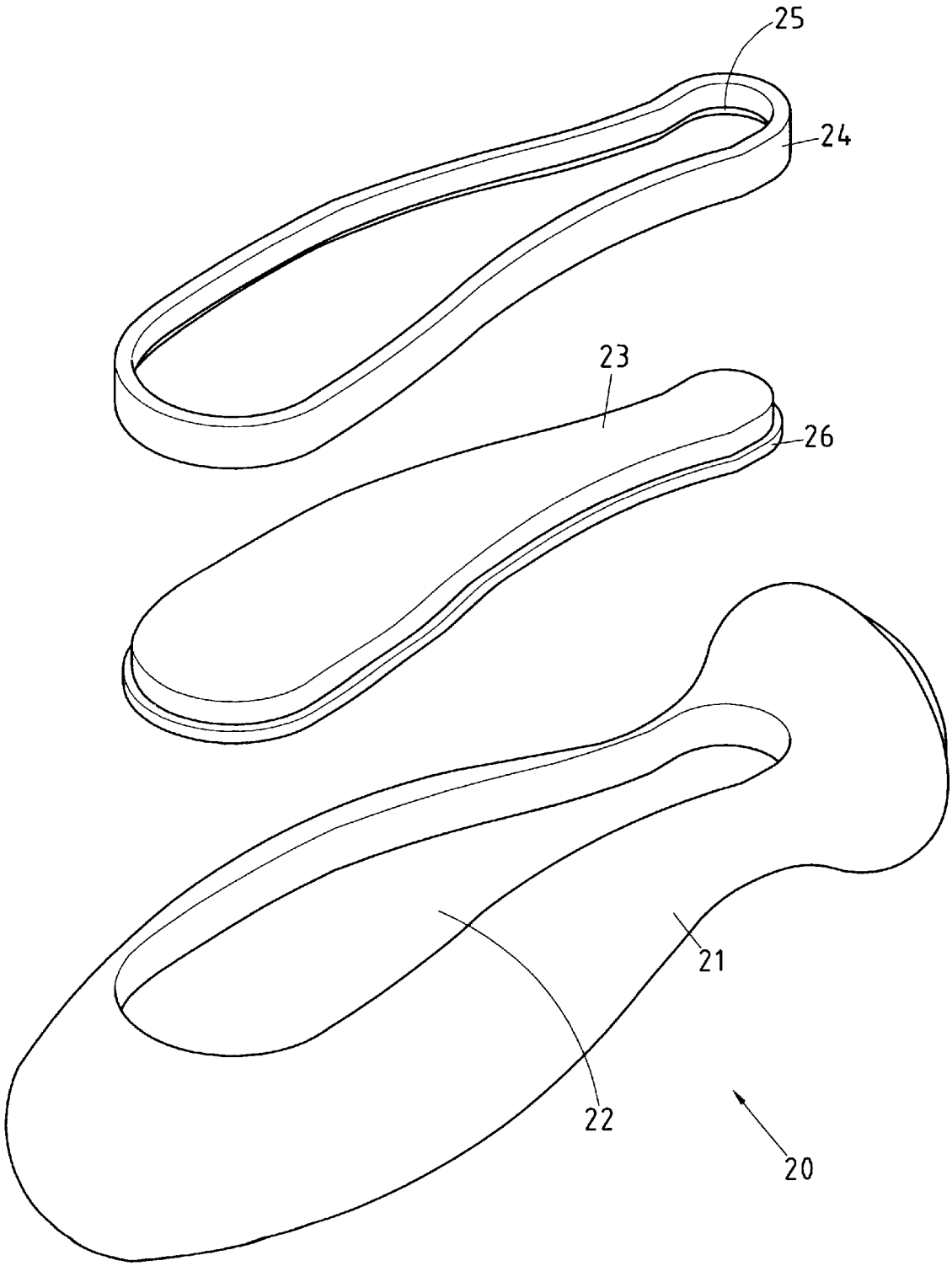
FIG. 6 shows another exploded view of the present invention.
Figure 7:
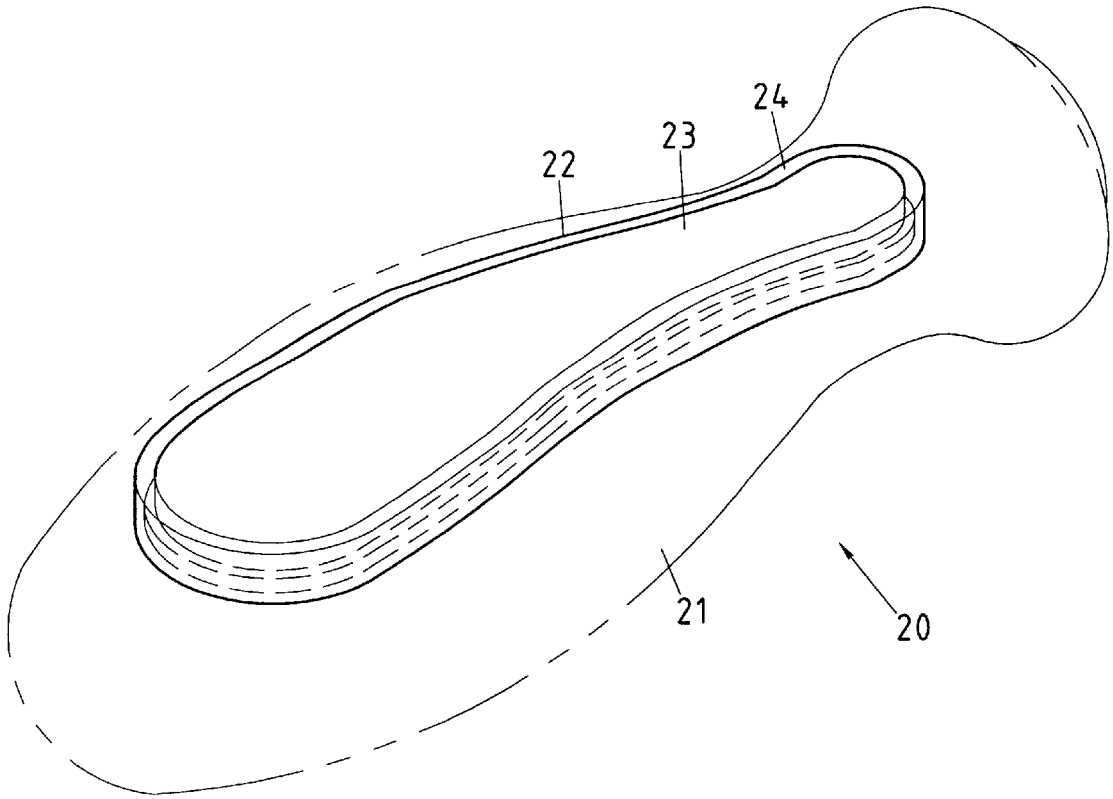
FIG. 7 shows a perspective view of the present invention as shown in FIG. 6.

As shown in FIGS. 3–7, a multicolored handle 20 embodied in the present invention comprises a main body 21, a plurality of colored blocks 23, and a plurality of retaining rings 24.

The main body 21 is provided in the outer surface thereof with a plurality of receiving slots 22.

The colored blocks 23 are different in color and shape from one another. In addition, the colored blocks 23 are different in color from the main body 21. The colored blocks 23 may be of any geometric form. However, the colored blocks 23 are corresponding in shape to the receiving slots 22 of the main body 21. The colored blocks 23 are provided in the outer wall thereof with a retaining projection 26.

The retaining rings 24 are corresponding in shape to the colored blocks 23 and the receiving slots 22 and are provided in the inner wall thereof with a retaining groove 25.

The retaining rings 24 may be different in color from the colored blocks 23 and the main body 21.

Each colored block 23 is fitted into the corresponding receiving slot 22 of the main body 21 in conjunction with the corresponding retaining ring 24. The colored block 23 is fitted into the retaining ring 24 such that the retaining projection 26 of the colored block 23 is retained in the retaining groove 25 of the retaining ring 24. The colored block 23 and the retaining ring 24 are held securely in place in the receiving slot 22 of the main body 21 by a strong adhesive.

The handle 20 of the present invention is thus provided with a variety of colors, thanks to the colored blocks 23 and the retaining rings 24.

The embodiment of the present invention described above is to be regarded in all respects as being merely illustrative and not restrictive. Accordingly, the present invention may be embodied in other specific forms without deviating from the spirit thereof. The present invention is therefore to be limited only by the scope of the following appended claims.

What is claimed is:

1. A multicolored handle comprising:

a main body provided in an outer surface thereof with at least one receiving slot;

at least one colored block different in color from said main body and corresponding in shape to said receiving slot of said main body whereby said colored block is provided in an outer wall thereof with a retaining projection;

at least one retaining ring corresponding in shape to said colored block and different in color from said colored block and said main body, said retaining ring provided in an inner wall thereof with a retaining groove whereby said retaining ring is fitted over said colored block such that said retaining projection of said colored block is retained in said retaining groove of said retaining ring, and that said retaining ring and said colored block are held securely in said receiving slot of said main body by a strong adhesive.

2. The multicolored handle as defined in claim 1, wherein said receiving slot, said colored block, and said retaining ring have the same geometric form which is not confined to any geometric form.

* * * * *